US005669374A

United States Patent [19]

Valters et al.

[11] Patent Number: 5,669,374

[45] Date of Patent: Sep. 23, 1997

[54] DIRECT VENT FIREPLACE

[75] Inventors: Tim Valters, Burlington; Dan Perz, Hamilton, both of Canada

[73] Assignee: GSW Inc., Hamilton, Canada

[21] Appl. No.: 516,633

[22] Filed: Aug. 18, 1995

[51] Int. Cl.[6] ..... F24C 3/00

[52] U.S. Cl. ..... 126/512; 126/513; 126/80

[58] Field of Search ..... 126/512, 513, 126/80; 237/53, 55, 50

[56] References Cited

U.S. PATENT DOCUMENTS

| | | | |
|---|---|---|---|
| 471,575 | 3/1892 | Shaw . | |
| 1,797,909 | 3/1931 | Ellsdorf | 237/53 X |
| 3,614,949 | 10/1971 | Goodgion . | |
| 4,487,195 | 12/1984 | Syme et al. . | |
| 4,793,322 | 12/1988 | Shimek . | |
| 4,909,227 | 3/1990 | Rieger . | |
| 5,267,552 | 12/1993 | Squires et al. . | |

FOREIGN PATENT DOCUMENTS

| | | |
|---|---|---|
| 847141 | 9/1960 | United Kingdom . |
| 2180333A | 3/1987 | United Kingdom . |

*Primary Examiner*—Larry Jones

[57] ABSTRACT

A direct vent gas fireplace is provided with a heat shield forming a combustion air expansion and distribution chamber covering a substantial portion of the upper surface of the firebox enclosure and having a circular combustion air inlet opening in its upper surface and being in communication with the lower portion of the firebox, and the products of combustion from the firebox are directed out of the fireplace through a pipe extending through the upper enclosure surface and out through the combustion air inlet opening in the heat shield with the axis of the pipe being offset from the center of the inlet opening so that when a combustion air inlet duct is sleeved over the pipe and connected to the inlet opening a portion of the combustion air path between the pipe and duct which feeds into the combustion air expansion and distribution chamber is substantially widened to provide space for the combustion air to expand outwardly rather than backing up the combustion air duct.

In its preferred form, the firebox and its enclosure have sloping upper surfaces sloping downwardly to the rear and the heat shield and combustion air expansion and distribution chamber is in the form of an inverted pan overlying and substantially covering the sloping enclosure surface.

13 Claims, 4 Drawing Sheets

FIG. 4.
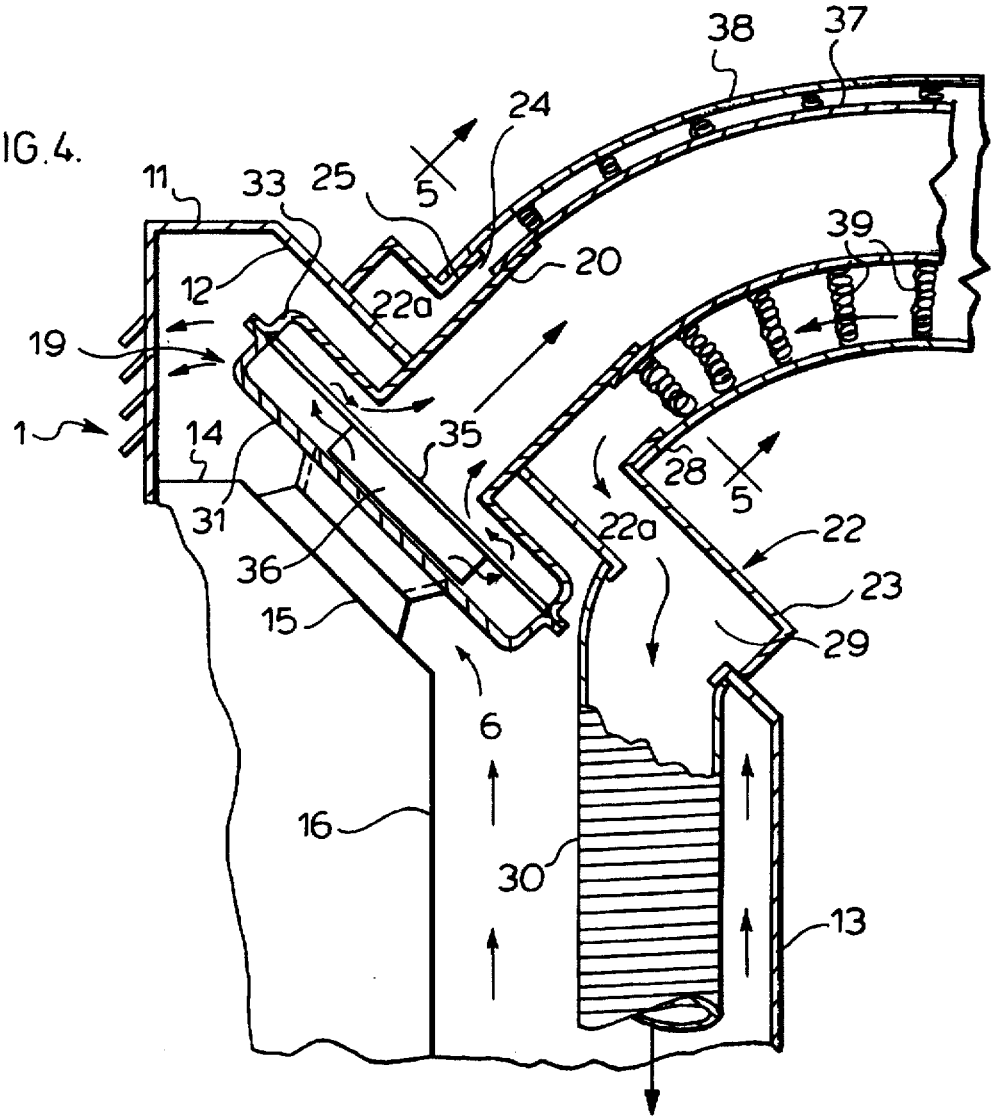
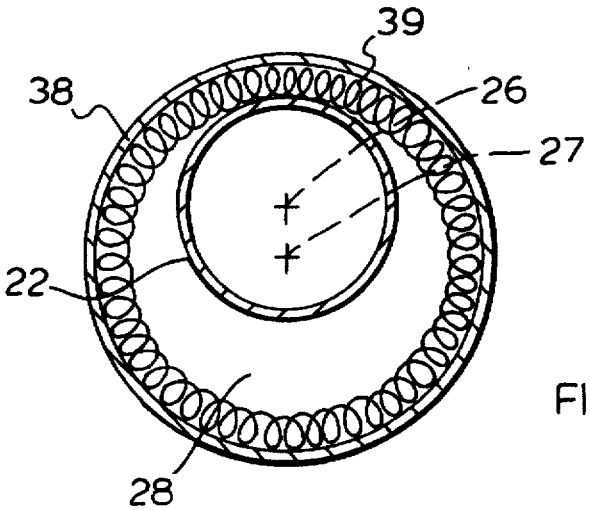
FIG. 5.

DIRECT VENT FIREPLACE

FIELD OF THEE INVENTION

This invention relates to direct vent gas fireplaces and, more particularly, to the provision of a more efficient, versatile and economical gas fireplace.

BACKGROUND OF THE INVENTION

Direct vent gas fireplaces which deliver exhaust products outwardly through an inner duct and draw combustion air inwardly through a surrounding outer duct have long been known.

U.K. 847,141 discloses such an arrangement with the exhaust products exhausting horizontally at the back of the fireplace.

Similarly, U.S. Pat. No. 4,793,322 discloses a direct vent gas fireplace with horizontal exhaust and combustion air intake flow at the back of the fireplace.

U.S. Pat. No. 3,614,949 discloses a top vented gas fired furnace in which the exhaust products and combustion air intake flow is vertical through the top of the unit.

U.S. Pat. No. 4,909,227 discloses a direct top venting gas fireplace in which the exhaust products emanate upwardly from the top of the fireplace into a horizontal run while combustion air is drawn in through the horizontal run and then flows downwardly through the fireplace top around the exiting exhaust products.

U.K. Patent Application GB 2,180,333-A discloses a gas fired unit in which the products of combustion are exhausted through a sloping rear wall to reduce the clearance required at the back for making connection with the exhaust path to the atmosphere.

Similarly, U.S. Pat. No. 471,575 discloses a ventilating grate in which the products of combustion are also vented through a sloping rear wall.

U.S. Pat. No. 4,487,195 discloses a heating apparatus that has a sloping rear wall portion and an adaptor to provide either a top exiting or rearward exiting flue connection.

U.S. Pat. No. 5,267,552 discloses a direct vent gas fireplace having a sloping rear wall and an adaptor to provide either a top exiting or rearward exiting venting connection.

One of the difficulties encountered when direct vent fireplaces are vented horizontally or with a horizontal run is that the hot exhaust fumes in the inner duct can transfer an excessive mount of heat to the incoming combustion air in the surrounding co-axial duct. When this combustion air is heated, it tends to try to exhaust slowing air intake. The result is that the heating effect, particularly adjacent the area where the exhaust fumes exit the fireplace and are at the hottest, can under certain conditions sufficiently block incoming air to extinguish the gas flame.

The present invention resides in providing, in a direct vent fireplace which provides for a generally horizontal ventilating run, an exhaust/combustion air intake arrangement that will effectively eliminate this problem of blocked combustion air flow while providing an efficient, economical and versatile fireplace.

SUMMARY OF THE INVENTION

According to the invention, the fireplace is provided with a heat shield forming a combustion air expansion and distribution chamber covering a substantial portion of the upper surface of the firebox enclosure, said combustion air expansion and distribution chamber having a circular inlet opening in its upper surface and being in communication with the lower portion of the firebox, and the products of combustion from the firebox are directed out of the fireplace through a pipe extending through said upper enclosure surface and out through said combustion air inlet opening in said heat shield with the axis of said pipe being offset from the center of said inlet opening so that when a combustion air inlet duct is sleeved over said pipe and connected to said inlet opening a portion of the combustion air path between said pipe and duct which feeds into the combustion air expansion and distribution chamber is substantially widened to provide space for the combustion air to expand outwardly rather than backing up the combustion air duct.

According to the preferred form of the invention, the firebox and its enclosure have sloping upper surfaces, and said heat shield and combustion air expansion and distribution chamber is in the form of an inverted pan overlying said sloping enclosure surface with the upper surface of the pan parallel thereto. A heat exchanger is interposed between the exhaust pipe and the firebox and said exhaust pipe is cylindrical and rigid and extends substantially at fight angles to said sloping enclosure and upper pan surfaces with its axis having a substantial offset from the center of the combustion air inlet opening in a direction up the slope of said sloping upper pan surface. Further the combustion air inlet opening has a surrounding mounting collar, the diameter of the pipe which extends above the heat shield corresponding to the diameter of the inner duct of a conventional flexible double walled vent ducting for connection therewith, and the diameter of the heat shield inlet opening and surrounding collar correspond to the diameter of the outer duct of such flexible double walled ducting for connection therewith.

BRIEF DESCRIPTION OF THE DRAWINGS

These and other features of the invention will be apparent from the following detailed description taken in conjunction with the accompanying drawings in which:

FIG. 4 is a broken away vertical sectional view illustrating the exhaust/combustion air intake arrangement and its connection to a double walled flexible vent ducting;

FIG. 5 is a sectional view on the line 5—5 of FIG. 4;

DETAILED DESCRIPTION ACCORDING TO THE PREFERRED EMBODIMENTS OF THE PRESENT INVENTION

Figure 1:
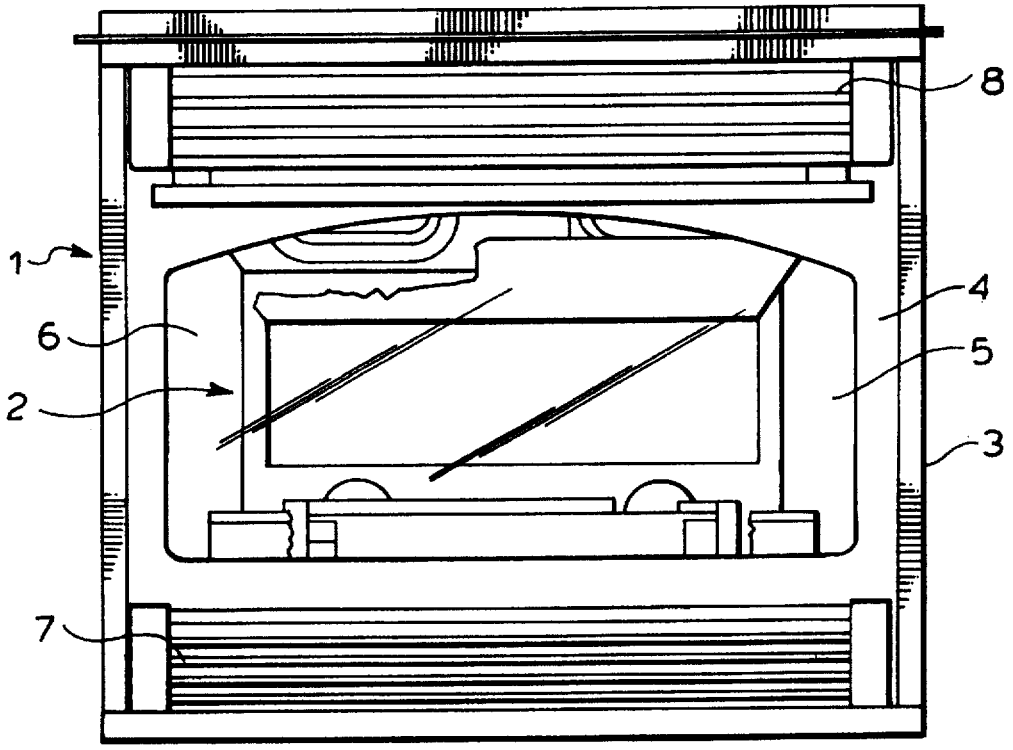
FIG. 1 is a front elevational view of a gas burning fireplace embodying the invention.
Figure 2:
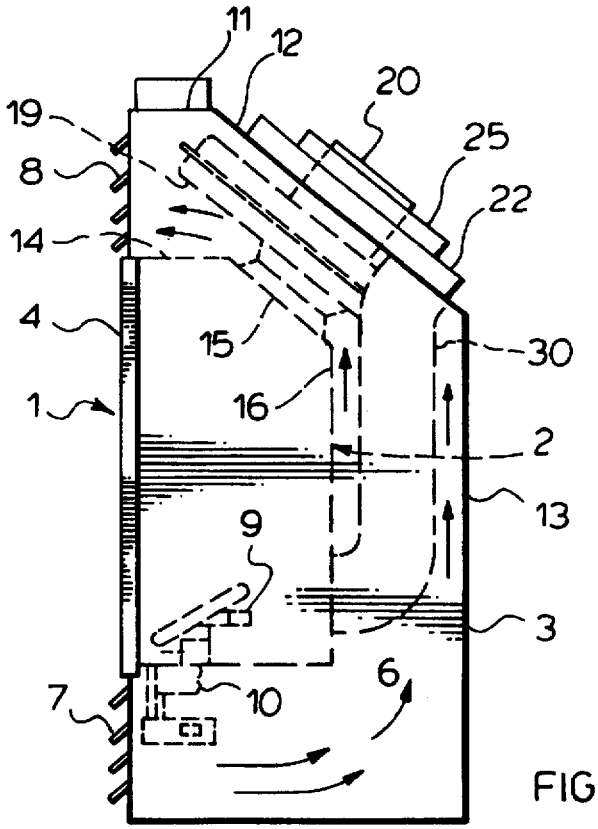
FIG. 2 is a side elevational view of the fireplace of FIG. 1 showing the internal firebox exhaust/combustion air intake arrangement in dotted line.

With reference to FIGS. 1 and 2, the fireplace generally designated at 1 is provided with a firebox 2 and a surrounding enclosure 3 provided with a viewing door 4 having a transparent viewing area 5.

The space 6 between the firebox 2 and the surrounding enclosure 3 provides for the circulation of room air to be heated which enters the enclosure through lower grill 7 and exits through upper grill 8.

If desired, a circulating fan, not shown, may be employed.

The fireplace illustrated is a gas burning fireplace provided with a burner unit 9 and appropriate controls designated at 10;

The top of the firebox enclosure 3 comprises a narrow horizontal top surface section 11 at the front of the fireplace and a sloping surface section 12 which slopes downwardly from the section 11 to the rear wall 13 of the enclosure.

The top surface of the firebox 2 has a generally similar configuration having a horizontal top surface section 14 at the front of the firebox and a rearwardly sloping section 15 sloping downwardly to the rear wall 16 of the firebox with the sloping firebox and enclosure sections 15 and 12 respectively being substantially parallel.

Figure 3:
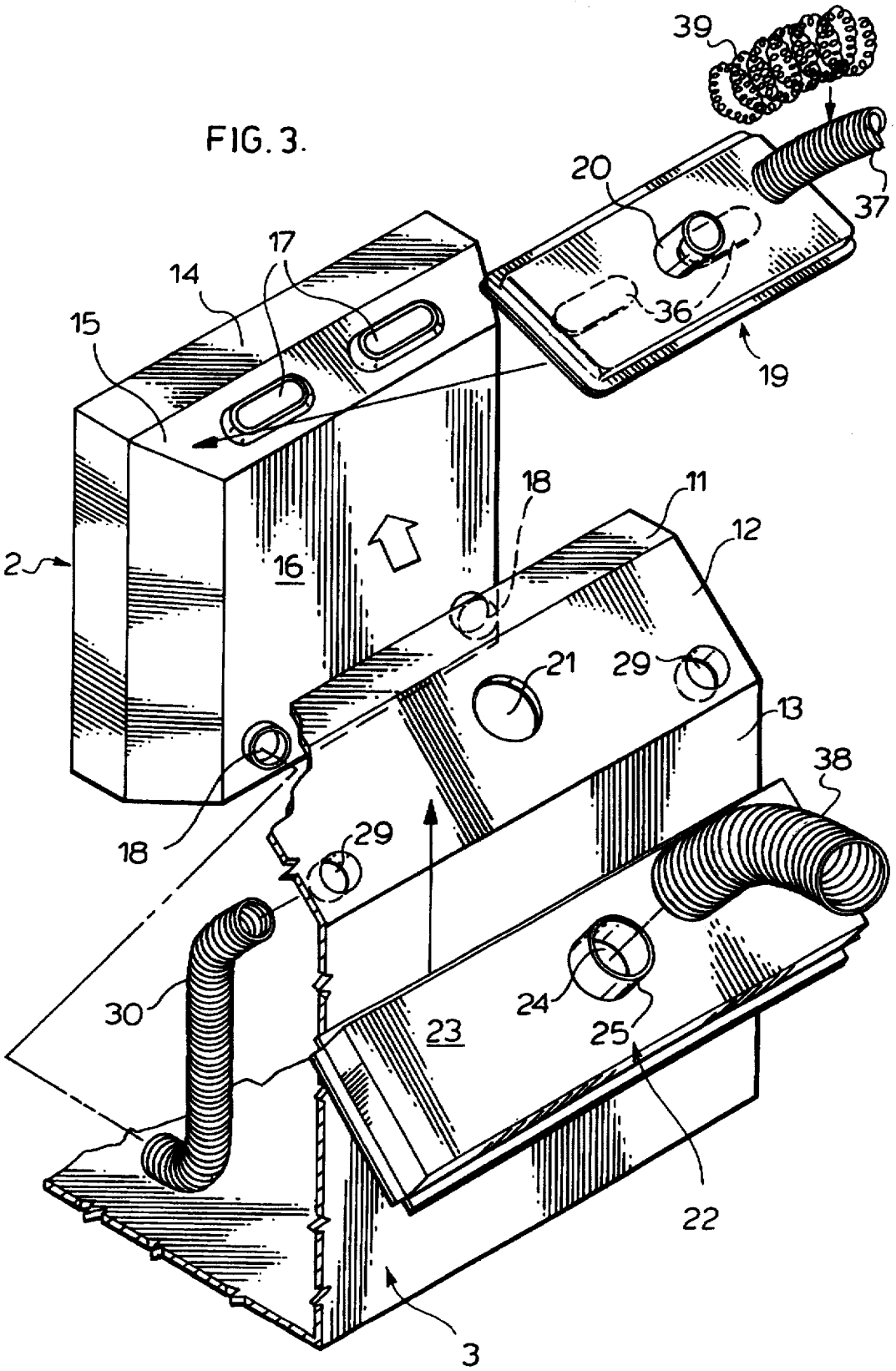
FIG. 3 is an exploded broken away perspective view showing the various component parts of the fireplace assembly.

As shown in FIG. 3, the firebox is slightly tapered in width to the rear and is provided with spaced elongated exhaust outlets 17 in the rearwardly sloping surface 15 and with spaced combustion air inlets 18 in the rear wall 16 adjacent the bottom thereof.

The products of combustion from the firebox are exhausted through the outlets 17 into a heat exchanger 19 to a centrally located rigid exhaust pipe 20 which communicates with the interior of the heat exchanger 19 and projects outwardly through a central hole 21 in the sloping enclosure surface 12 as shown in FIG. 3. As illustrated, the heat exchanger 19 lies between and is generally parallel to the firebox and enclosure sloping sections 15 and 12 and the rigid exhaust pipe 20 extends substantially perpendicular to these sloping sections.

Overlying and substantially covering the sloping enclosure surface 12 is an inverted pan which forms a heat shield 22 and as well a combustion air intake expansion and distribution chamber as will hereinafter be more fully explained. The bottom 23 of the pan which forms the upper surface of the heat shield 22 extends substantially parallel to the sloping enclosure surface 12.

This heat shield upper surface 23 is provided with a circular combustion air inlet opening 24 centrally of the width thereof provided with a surrounding mounting collar 25.

The combustion air inlet opening 24 has a diameter substantially greater than the diameter of the exhaust pipe 20 which is arranged to extend therethrough to project thereabove.

For a purpose more fully explained below, the pipe 20 and opening 24 have an eccentric relationship with the axis of the pipe indicated at 26 in FIG. 5 being displaced up the slope of the heat shield surface 23 from the center 27 of the opening 24 whereby the passageway 28 between the pipe and the combustion air inlet 24 is significantly widened at what may be considered the underside of the pipe 20.

As shown in FIG. 3, the sloping enclosure surface 12 is provided with a pair of spaced combustion air exit openings 29 adjacent the enclosure rearwall 13 which are connected to the combustion air inlets 18 in the firebox by tubes in the form of flexible ducts 30.

Figure 6:
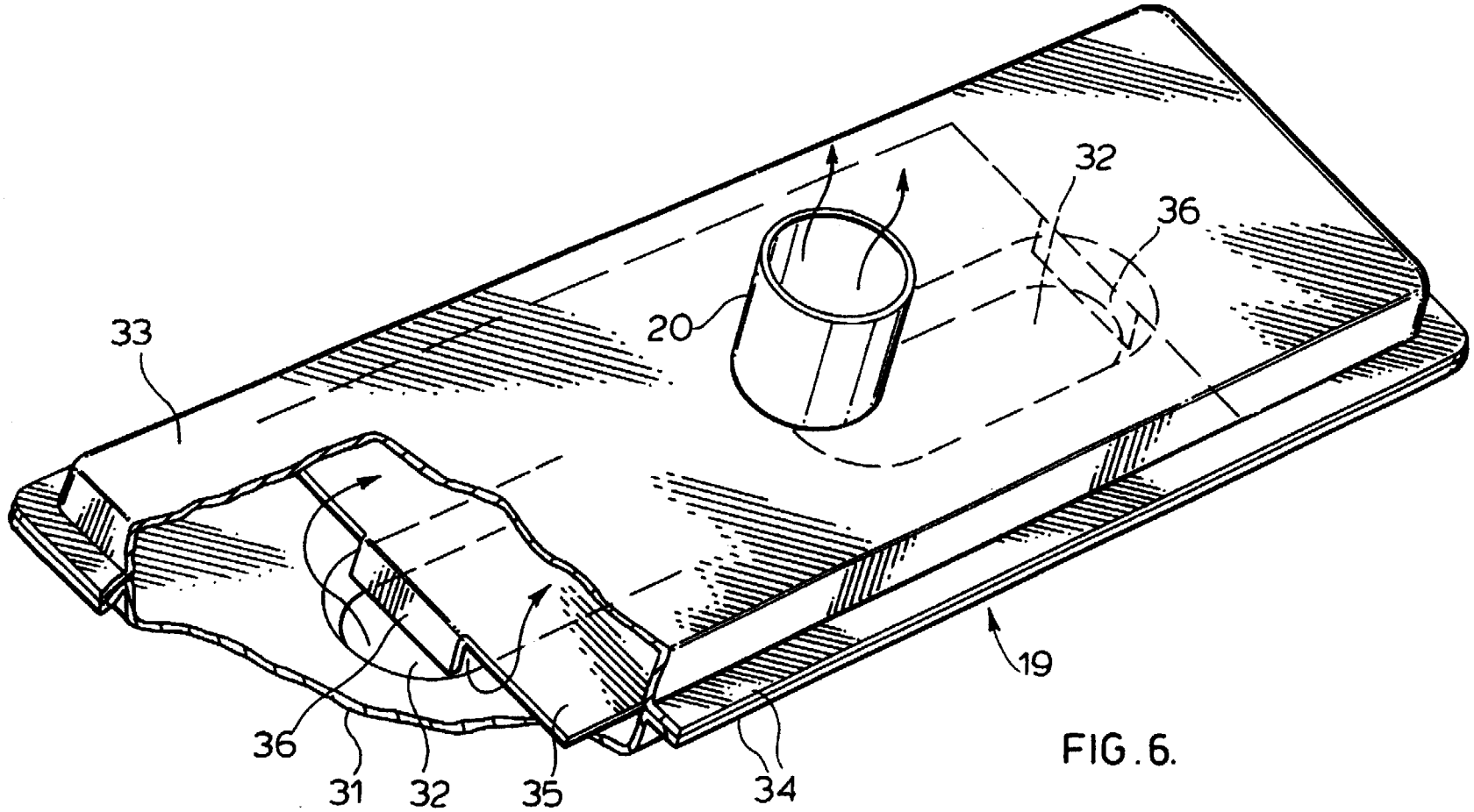
FIG. 6 is a broken away perspective view of the heat exchanger interposed in the exhaust system.

As shown particularly in FIG. 4, the heat shield 22 overlies the enclosure surface openings 29 to provide a closed path for combustion air entering through the inlet 24 into the interior of the heat shield 22 which forms a combustion air expansion and distribution chamber 22*a* delivering the combustion air to the ducts 30 which feed into the bottom of the firebox;

As illustrated more particularly in FIG. 6, the heat exchanger 19 has a bottom pan 31 provided with intake openings 32 corresponding in shape to the exhaust outlets 17 in the firebox sloping surface 15 and arranged to register therewith.

An inverted upper pan 33 has the exhaust pipe 20 which opens into the interior thereof secured thereto and projecting therefrom centrally thereof. The pans 31 and 32 have flanges 34 which are welded together with a baffle plate 35 located therebetween and extending over the major portion of the intake openings 32 in the bottom pan and having dependent end flanges 36. These flanges 36 block the majority of the exhaust products entering openings 32 from flowing directly from the underside of the plate 35 to the upper side thereof forcing such products to spread laterally to increase the tortuous path of flow to the exhaust pipe 20.

It has long been considered an accepted requirement for free standing fireplaces such as the gas fireplace disclosed that such fireplaces must be direct vented by means of a double walled ducting, that is, ducting comprising an inner exhaust duct leading outside to a suitable vent cap and an outer surrounding duct bringing in combustion air which cools the exhausting combustion products while being preheating thereby.

As a example by way of illustration only, the fireplace of the present invention may be adapted for direct venting with a double walled flexible ducting having a four inch diameter exhaust inner duct 37 and a seven inch diameter outer duct 38 employing circular coiled springs 39 which act to urge the ducts into concentric relationship but permit displacement therebetween to an eccentric position as illustrated in FIG. 4.

As seen in FIG. 4, the inner duct 37 is coupled to the exhaust pipe 20 at a point beyond the heat shield 22 while the duct 38 is connected to the collar 25 of the combustion air inlet 24 to cause the pipes to be moved into an eccentric relationship as permitted by the springs 39 which also function to prevent contact between the ducts 37 and 38.

In the operation of the fireplace, the products of combustion are forced to flow through the tortuous path provided by the heat exchanger 19 to reduce the heat in the exhaust pipe 20 while increasing the heat available for the room air being circulated throughout the space 6 between the grills 7 and 8.

By having the eccentric relationship between the exhaust pipe 20 and the combustion air inlet opening 24 and the inner exhaust duct 37 and the outer combustion air intake duct 38 at and adjacent the vicinity of the exhaust pipe 20, the widened passage way 28 is provided at the underside of the exhaust pipe which allows the heating incoming combustion air to expand outwardly rather than back up the duct 38. With this arrangement, it has been found that the combustion air can continue to flow in this area until it dumps into the expansion and distribution chamber 22*a* where it can expand with such expansion assisting the incoming air flow.

With this arrangement, it has been found that even though there is a significant horizontal aspect to the vent arrangement as illustrated combustion air will not be cut off to effect the extinguishment of the gas flame. It will also be appreciated that the vent ducting 37, 38 may be oriented vertically for a top vent application as well as horizontally for a rear vent application.

By having the exit openings 29 from the expansion and distribution chamber 22*a* located in widely spaced relation and adjacent the enclosure rear wall 13 the incoming relatively cool combustion air is caused to spread widely over the sloping enclosure surface 12 where heating is the greatest to add to the effectiveness of the heat shield 22 to protect against injury on contact therewith.

It will be understood that variations in detail may be made without department from the scope of the appended claims.

The embodiments of the invention in which an exclusive property or privilege is claimed are defined as follows:

1. A direct vent fireplace having a firebox, an enclosure for said firebox spaced therefrom to provide an air passage therearound for the circulation of room air to be heated by a fire in the firebox, a heat shield mounted on and covering a substantial portion of the upper surface of said enclosure, and forming with said upper enclosure surface a combustion air heating and expansion and distribution chamber, said combustion air expansion and distribution chamber having a circular inlet opening in its upper surface and being in communication with the lower portion of the firebox, and an exhaust pipe having a substantially smaller diameter than said heat shield inlet opening in communication with the interior of the firebox for directing the products of combustion from the firebox out of the fireplace extending through said upper enclosure surface and out through said combustion air inlet opening in said heat shield with the axis of said pipe being offset from the center of said inlet opening so that when a combustion air inlet duct is sleeved over said pipe and connected to said inlet opening a portion of the combustion air path between said pipe and duct which feeds into said combustion air expansion and distribution chamber is substantially widened to provide a space for the combustion air to expand outwardly rather than backing up the combustion air duct.

2. A fireplace as claimed in claim 1 in which said upper surface of said firebox enclosure substantially covered by said combustion air expansion and distribution chamber slopes rearwardly downwardly from a horizontal top enclosure surface to a vertical rear enclosure surface.

3. A fireplace as claimed in claims 2 or 1 in which a heat exchanger is interposed between said pipe and said firebox.

4. A fireplace as claimed in claim 2 in which said pipe extends substantially at right angles to said upper enclosure surface.

5. A fireplace as claimed in claims 2 or 1 in which said combustion air expansion and distribution chamber is formed by an inverted pan covering said substantial portion of said upper enclosure surface.

6. A fireplace as claimed in claim 5 in which said combustion air expansion and distribution chamber is in communication with the lower portion of said firebox by at least one delivery duct extending from an opening in said upper enclosure surface located within said chamber and spaced away from said inlet opening to an opening in the lower part of said firebox.

7. A fireplace as claimed in claim 6 having a pair of said delivery ducts arranged in spaced relation.

8. A direct vent gas fireplace comprising a firebox, an enclosure for said firebox spaced therefrom to provide an air passage therearound for the circulation of room air to be heated by a fire in said firebox, said firebox and enclosure each having a sloping upper surface section sloping rearwardly downwardly to a rear surface, a heat shield comprising an inverted pan substantially covering said sloping enclosure surface section with the bottom of said pan substantially parallel said sloping enclosure surface section and forming therewith a combustion air expansion and distribution chamber, said pan having a circular combustion air inlet opening in the bottom thereof, at least one opening in said sloping enclosure surface section beneath said pan, a combustion air feed duct leading from said opening and exiting into said firebox adjacent the bottom thereof, an exhaust pipe in communication with the interior of said firebox through a heat exchanger projecting angularly upwardly and rearwardly through said sloping enclosure surface section and through said inlet opening to project thereabove with the axis of said pipe offset from the center of said inlet opening in a direction up the slope of said enclosure section, said pipe being adapted for connection with the inner duct and said combustion air inlet opening being adapted for connection to the outer duct of a flexible doubled walled ducting.

9. A fireplace as claimed in claim 8 in which said combustion air inlet opening has a surrounding collar adapted for attachment to the outer duct of a flexible double walled vent ducting.

10. A fireplace as claimed in claim 9 in which said heat exchanger comprises a baffle arrangement between said sloping firebox and enclosure surface sections for providing a tortuous path for products of combustion between said firebox and said pipe.

11. A fireplace as claimed in claims 8, 9 or 10 having a pair of openings in said sloping enclosure surface section beneath said pan spaced from each other and from said inlet opening with each of said pair of openings being connected by ducting which exits into the lower portion of said firebox.

12. A direct vent gas fireplace comprising a firebox, an enclosure for said firebox spaced therefrom to provide an air passage therearound for the circulation of room air to be heated by a fire in said firebox, said firebox and enclosure having substantially parallel sloping upper surface sections sloping rearwardly and downwardly to rear surfaces, said fireplace having a rearwardly and downwardly sloping generally rectilinear combustion air distribution chamber spaced from said sloping upper firebox surface and substantially parallel thereto, said distribution chamber having a combustion air inlet in the upper surface thereof adjacent the upper end thereof and centrally of the width thereof and laterally spaced combustion air outlets in the bottom surface thereof adjacent the lower end thereof, conduit means located wholly within said air passage around said firebox connecting said combustion air outlets to the rear of said firebox adjacent the bottom thereof, a heat exchanger in communication with said firebox mounted beneath said combustion air distribution chamber, an exhaust pipe in communication with and extending from said heat exchanger through said distribution chamber and out through said combustion air inlet and beyond said enclosure.

13. A direct vent fireplace as claimed in claim 12 in which said heat exchanger is disposed parallel to and between said sloping upper surface section of said firebox and said sloping air distribution chamber and said exhaust pipe is secured to said heat exchanger and extends substantially perpendicular thereto.

* * * * *